United States Patent [19]

Prew

[11] Patent Number: 4,545,538

[45] Date of Patent: Oct. 8, 1985

[54] HOG GRANULATOR

[75] Inventor: Stanley R. Prew, Montoursville, Pa.

[73] Assignee: Koppers Company, Inc., Pittsburgh, Pa.

[21] Appl. No.: 566,525

[22] Filed: Dec. 29, 1983

[51] Int. Cl.[4] ..... B02C 18/16

[52] U.S. Cl. ..... 241/73; 241/242; 241/294

[58] Field of Search ..... 241/73, 243, 242, 241, 241/222, 224, 293, 294, 295, 285

[56] References Cited

U.S. PATENT DOCUMENTS 2,222,073 11/1940 Hauge ..... 241/294 X 4,106,708 8/1978 Kropa ..... 241/222

4,171,778 10/1979 LeJeune ..... 241/294

*Primary Examiner*—Mark Rosenbaum

*Attorney, Agent, or Firm*—Daniel J. Long; Herbert J. Zeh, Jr.

[57] ABSTRACT

A hog granulator for plastic material in which a plurality of longitudinal knives are arranged on a rotor inside a cutting chamber to engage in a cooperative cutting action with bed knives on the cutting chamber walls. A plurality of spaced, longitudinal pockets in the peripheral surface of the rotor bring cooling air to the cutting surfaces, and ribs are arranged across these pockets to reduce power requirements by preventing excessively large pieces of plastic material to be reduced from being received into and taking up residence in these pockets.

12 Claims, 3 Drawing Figures

HOG GRANULATOR

BACKGROUND OF THE INVENTION

1. Field of the Invention

The present invention relates to machines for reducing scrap plastic material and in particular to open hog rotor granulators.

2. Description of the Prior Art

Due to the high cost of virgin material it has in the plastics industry generally become the practice to recycle as much waste plastic as is possible. Such waste plastic will often include "purgings" formed by the purging of an injection molder and residual plastic remaining at the end of a production run as well as film, pipe and other rejected parts. This recycling operation is conventionally carried out in a "central" or "hog" granulator, which generally includes a central rotor with a plurality of longitudinal knives that interact with a bed knife on the wall of a cutting chamber to granulate plastic material fed into the chamber. Such hog granulators have heretofore been of two general types, open rotor and closed rotor.

An open rotor type device has a number of elongated, longitudinal pockets in the surface of the rotor. After pieces of plastic material are initially cut from larger pieces of material being fed into the cutting chamber but while such cut-off pieces are still too large to pass through a sizing screen positioned below the rotor, these cut-off pieces take up residence in these pockets while they are further reduced by the cooperative cutting action of the longitudinal knives on the rotor and the bed knife. While this open rotor design allows cooling air to dissipate heat generated by the cutting action, its disadvantage is that machines of this design will often accept into the cutting chamber pieces of plastic material to be reduced which are disadvantageously large. The principal limitation affecting the size of such pieces of plastic material to be reduced will be the size of the pockets in the rotor. Since these pockets typically run the entire length of the rotor, oversized pieces of material to be reduced will occasionally be received and take up residence in them. The fact that such large pieces of material to be reduced may be accepted into the cutting chamber requires that a relatively large motor be connected to the machine to accommodate power surges. Furthermore, a machine of an open rotor design must also be of relatively heavy construction to withstand such power surges and shock loads.

The closed rotor differs from the open rotor in that there are no pockets adjacent to the knives on the rotor surface. The surface of the rotor is effectively regular except for the knife tip projections. The advantage to this design is that power surging is minimized since the knives can only cut off material in pieces as large as the knife projections. Since, however, there are no pockets, pieces of cut-off material to be reduced which are too large to pass through the sizing screen positioned beneath the rotor will be retained between the rotor and the screen while subsequent cuts on it by the fly and bed knives are made. Due to the usually close proximity of the rotor and the screen, severe rubbing between the rotor and the retained plastic material to be reduced may occur, and large amounts of heat may be generated. The generation of this heat coupled with the introduction of only limited amounts of cooling air due to the regular surface of the rotor will sometimes result in the softening or melting of many plastic materials unless the machine's through-put rate is kept at an undesirably low level.

In view of the above described disadvantages of hog rotor granulators heretofore known, it is the object of the present invention to provide a machine of this kind which is not subject to power surges and does not require the use of a motor of unduly large capacity but which also allows heat to be effectively dissipated.

SUMMARY OF THE INVENTION

The hog rotor granulator of the present invention includes a central rotor and, like the open rotor type granulars described above, this rotor has a plurality of longitudinal pockets which are arranged at spaced intervals along the periphery of the rotor. Each of the pockets forms a seat in the rotor surface which seat includes a generally flat base section and an upstanding shoulder at the terminal end of the base section. A generally radial and longitudinally oriented knife is fixed to each of these shoulders. A bed knife is fixed to a wall of the cutting chamber in cooperative cutting relation with the longitudinal knives on the rotor. One or more ribs extend from the shoulder to the base on the seat of each cut-out portion of the rotor so that excessively large pieces of material to be reduced will not take up residence lodged in the pockets of the rotor while ample amounts of cooling air will still be provided to the cutting surfaces.

BRIEF DESCRIPTION OF THE DRAWINGS

The present invention is further described by the accompanying drawings in which.

DETAILED DESCRIPTION

Figure 1:
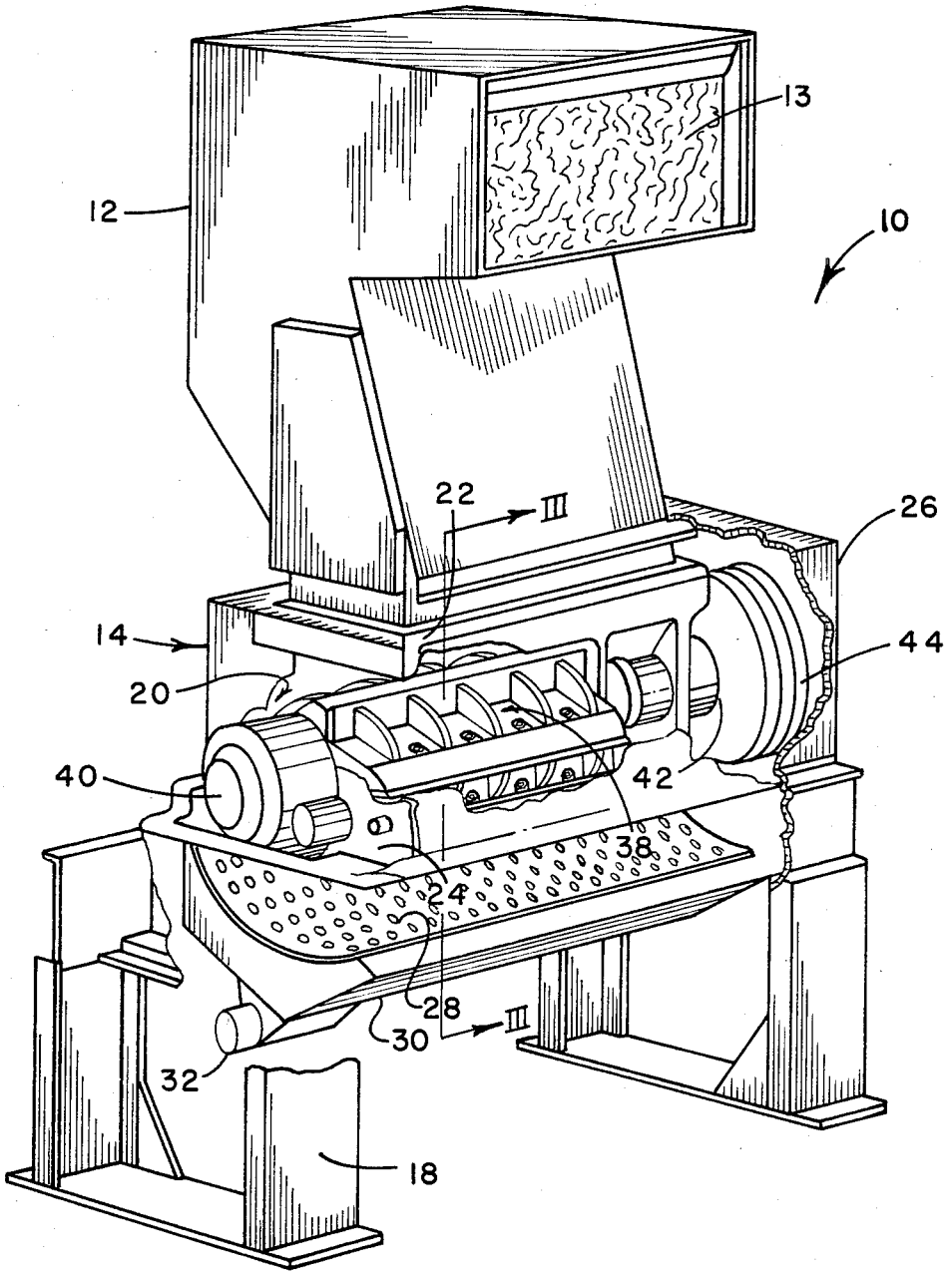
FIG. 1 is a cut away, perspective view of a hog granulator representing a preferred embodiment of the present invention.

With reference to the drawings, a hog granulator is shown generally at numeral 10. This hog granulator includes a hopper 12 having an upper opening 13 covered by curtains or some other type of flap through which scrap plastic material to be reduced is fed before being introduced into a cutting chamber shown generally at numeral 14. This cutting chamber has an upper opening 16 (FIG. 3) through which the material to be reduced enters from the lower end of the hopper. The cutting chamber is supported by a frame 18; and also has two opposed side walls 20 and 22 as well as two end walls 24 and 26. Below the cutting chamber there is a concave screen 28 which has holes which will allow material which has been reduced to a sufficiently small size to pass through to a generally concave, inclined screen cradle 30 positioned below the screen for receiving and collecting sufficiently reduced plastic material. Such material slides downwardly on the inclined cradle and is removed through transition chute 32.

Mounted on the side walls 20 and 22 of the cutting chamber there are, respectively, bed knives 34 and 36 (FIG. 3), and positioned between these bed knives is a rotor shown generally at numeral 38. At end wall 24, this rotor is mounted at rotor bearing 40. At its opposite end it passes through bushing 42 and has a flywheel 44 fixed to its end.

Figure 2:
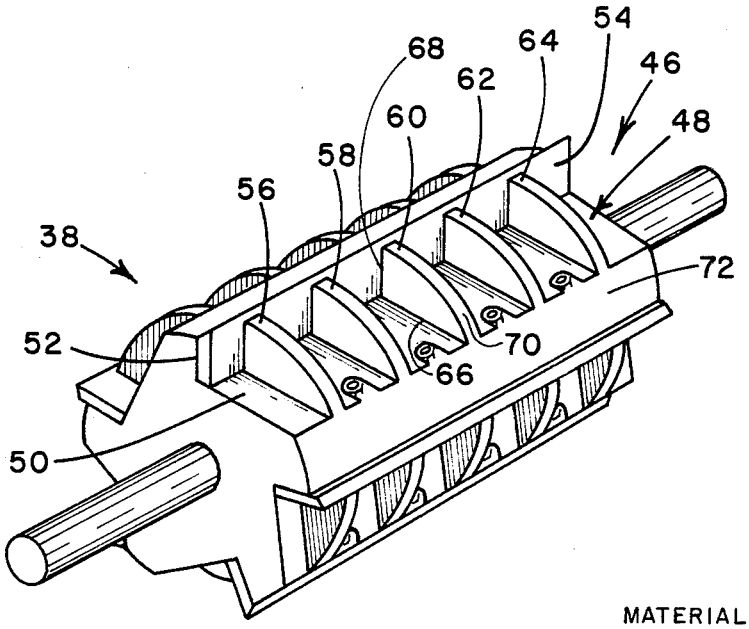
FIG. 2 is a perspective view of the rotor element of the hog granulator shown in FIG. 1.
Figure 3:
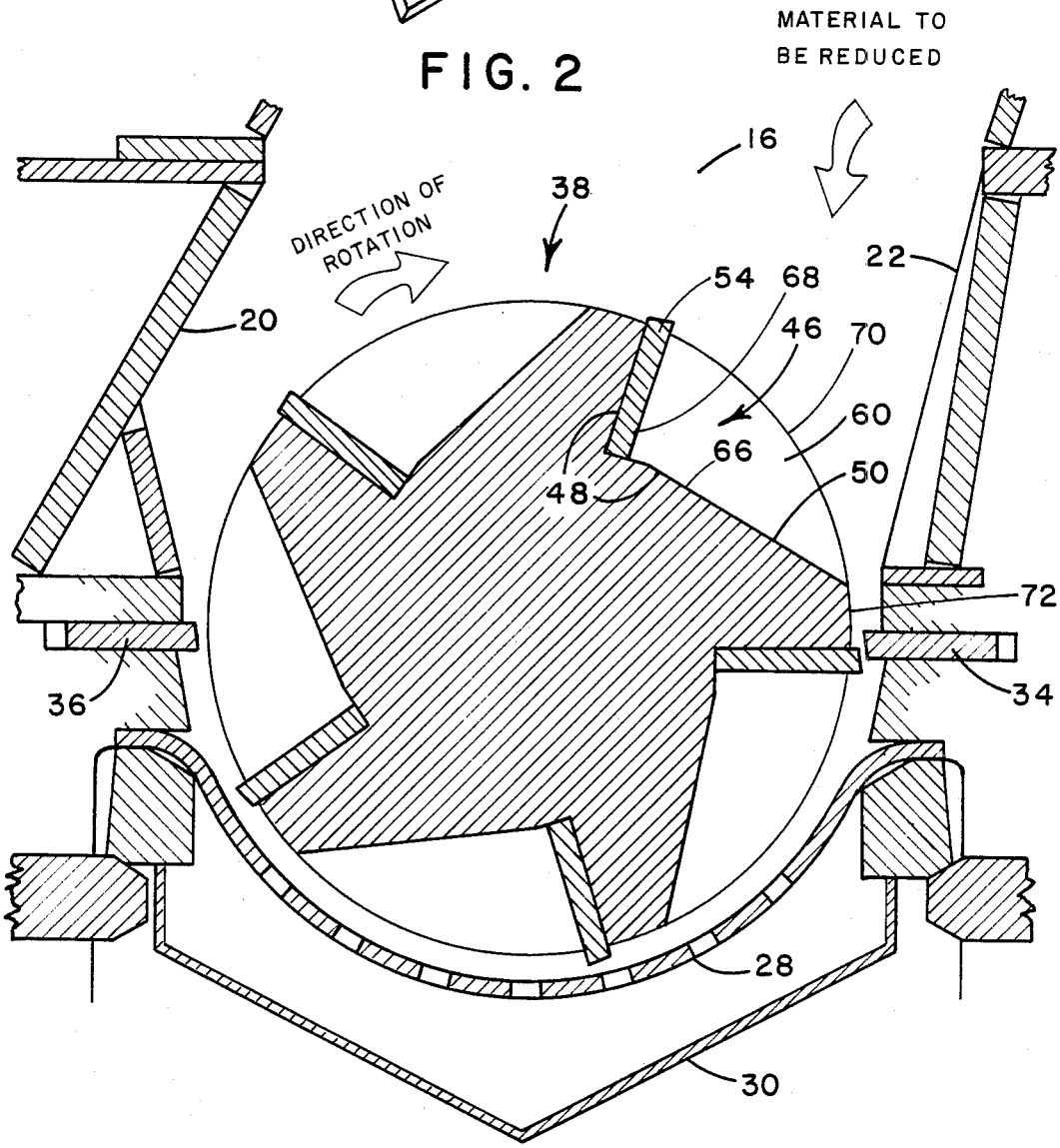
FIG. 3 is a cross sectional view taken through line III—III in FIG. 1.

Referring particularly to FIGS. 2 and 3, it will be seen that the rotor has a plurality of longitudinal pockets or cut-out portions as at 46 which are arranged at spaced intervals on its periphery. Each of the pockets forms a seat as at 48 on the rotor surface. The seat is made up of a base section 50 which generally follows a chord from a point on the rotor's peripheral surface but which terminates before reaching another point on the rotor's periphery. At this terminal end of the base section there is an upstanding shoulder section 52 which extends outwardly to the periphery of the rotor. Fixed to the shoulder section is a fly knife 54 which engages in a cooperative cutting relationship with the bed knives as the rotor is rotated about its longitudinal axis by an electric motor (not shown).

Extending across the pocket 46 from the base section to the shoulder section of the seat there are five ribs 56, 58, 60, 62 and 64. Each of these ribs has, like rib 60, a bottom surface 66 and side surface 68 which is generally perpendicular to this bottom surface. These ribs also have an arcuate top surface 70 which is coplanar with the rotor peripheral surface 72. Preferably each of these ribs will be spaced from its adjacent ribs by a distance of from about 4 inches to about 5 inches, and each of these ribs will be from about $\frac{3}{4}$ inch to about $1\frac{1}{4}$ inches in thickness.

As the rotor is rotated about its longitudinal axis, material to be reduced is fed through the hopper and into the cutting chamber. If a piece of material to be reduced is small enough to fit between two adjacent ribs it will take up residence in a pocket and be reduced by the successive cooperative cuts of its adjacent fly knife and the bed knives. If, however, a piece of material to be reduced is too large to fit between two adjacent ribs it will not take up residence in a pocket and thus not be received into the cutting chamber. Because such large pieces of material to be reduced are not received into the cutting chamber, large power demands can be avoided. It will also be appreciated that the above described apparatus will allow cooling air to efficiently reach the cutting surface to dissipate heat.

Although the invention has been described with a certain degree of particularity, it is to be understood that the present disclosure has been made only as an example and that the scope of the invention is defined by what is hereafter claimed.

What is claimed is:

1. In a granulator for size reduction of a plastic material comprising a cutting chamber; a generally cylindrical rotor mounted within said cutting chamber for rotation about its longitudinal axis, said rotor having a plurality of spaced, longitudinally extending pockets cut out from its peripheral surface to permit heat dissipating air flow; a plurality of spaced, longitudinal knives peripherally fixed to said rotor, one of said knives being positioned adjacent each of said pockets; means for driving said rotor about its longitudinal axis; at least one bed knife situated for cooperative cutting relationship with said rotor knives as said rotor is driven to effect size reduction of plastic material fed into said chamber, wherein the improvement comprises a plurality of rib members spaced from one another at a distance of from about 4 inches to about 5 inches, said rib members each having a top surface of a sufficient width of at least about $\frac{3}{4}$ inch to avoid significant cutting of the plastic material to be reduced and extending across each of said pockets such that excessively large pieces of the plastic material to be reduced will be prevented from taking up residence in said pockets.

2. The granulator as recited in claim 1 wherein the pockets each form a seat on the rotor peripheral surface, each of said seats having a generally flat base section extending in a generally chord-like manner from a peripheral point on the rotor but terminating before reaching another peripheral point on the rotor and an upstanding shoulder section extending generally perpendicularly from the terminal end of said base section to the peripheral surface and wherein the rib members extending across the pockets extend from the base section to the shoulder section of the seat formed by each of said pockets.

3. The granulator as recited in claim 2 wherein each rib has generally perpendicular bottom and side surfaces which abut, respectively, the base and shoulder sections of the seat in which it is positioned and an arcuate top surface which is coplanar with the rotor peripheral surface.

4. The granulator as recited in claim 2 wherein a fly knive is fixed in juxaposed relation to the shoulder section of the seat formed by each pocket and extends in a generally radial fashion beyond the rotor peripheral surface.

5. The granulator as recited in claim 1 wherein a hopper for receiving plastic material to be reduced in the granulator is positioned above the cutting chamber and is connected to said cutting chamber by means of an opening.

6. The granulator as recited in claim 1 wherein a concave screen is positioned below the rotor to prevent the discharge of insufficiently reduced plastic material.

7. The granulator as recited in claim 6 wherein a generally concave, inclined material receiving cradle is positioned beneath the screen for collection of reduced plastic material passing through the screen.

8. The granulator as recited in claim 7 wherein a transition chute is positioned at the lower end of the inclined material receiving cradle for removal of reduced plastic material collected on the cradle.

9. The granulator as recited in claim 1 wherein the rotor is rotatably retained in a bearing fixed to a wall of the cutting chamber at least at one of its ends.

10. The granulator as recited in claim 9 wherein the rotor is rotatably retained in a bearing fixed to a wall of the cutting chamber at one of is ends and has a flywheel at its other end and is rotatably retained in a bushing inwardly adjacent to said flywheel.

11. The granulator as recited in claim 1 wherein the ribs are from about $\frac{3}{4}$ inch to about $1\frac{1}{4}$ inch in thickness.

12. In a granulator for size reduction of a plastic material comprising a cutting chamber; a generally cylindrical rotor mounted within said cutting chamber for rotation about its longitudinal axis, said rotor having a plurality of spaced, longitudinally extending pockets cut out from its peripheral surface to permit heat dissipating air flow; a plurality of spaced, longitudinal knives arranged in parallel relation to the longitudinal axis of the rotor and peripherally fixed to said rotor, one of said knives being positioned adjacent each of said pockets; means for driving said rotor about its longitudinal axis; at least one bed knife situated for cooperative cutting relationship with said rotor knives as said rotor is driven to effect size reduction of plastic material fed into said chamber, wherein the improvement comprises a plurality of rib members spaced from one another at a distance of from about 4 inches to about 5 inches, said rib members each having a top surface of a sufficient width of at least about $\frac{3}{4}$ inch to avoid significant cutting of the plastic material to be reduced and extending across each of said pockets such that excessively large pieces of the plastic material to be reduced will be prevented from taking up residence in said pockets.

* * * * *